US009386650B2

(12) United States Patent
Cho

(10) Patent No.: US 9,386,650 B2
(45) Date of Patent: Jul. 5, 2016

(54) LED LIGHTING DEVICE AND METHOD OF CONTROLLING THE SAME

(71) Applicant: EMFIRST, Gyeonggi-do (KR)

(72) Inventor: Byoung Og Cho, Gyeonggi-do (KR)

(73) Assignee: EMFIRST, Gyeonggi-do (KR)

( * ) Notice: Subject to any disclaimer, the term of this patent is extended or adjusted under 35 U.S.C. 154(b) by 0 days.

(21) Appl. No.: 14/436,103

(22) PCT Filed: Dec. 26, 2012

(86) PCT No.: PCT/KR2012/011436

§ 371 (c)(1),
(2) Date: Apr. 16, 2015

(87) PCT Pub. No.: WO2014/061866

PCT Pub. Date: Apr. 24, 2014

(65) Prior Publication Data

US 2015/0289336 A1 Oct. 8, 2015

(30) Foreign Application Priority Data

Oct. 17, 2012 (KR) ..... 10-2012-0115536
Dec. 26, 2012 (KR) ..... 10-2012-0152898

(51) Int. Cl.
*H05B 33/08* (2006.01)

(52) U.S. Cl.
CPC ..... *H05B 33/0848* (2013.01); *H05B 33/089* (2013.01); *H05B 33/0827* (2013.01); *H05B 33/0875* (2013.01)

(58) Field of Classification Search
CPC ..... H05B 33/0827; H05B 33/0815; H05B 33/0851; H05B 33/083; H05B 33/0824; H05B 33/086; H05B 33/089; H05B 33/0884; H05B 33/0875
See application file for complete search history.

(56) References Cited

U.S. PATENT DOCUMENTS

2010/0164403 A1* 7/2010 Liu ..... H05B 33/086 315/297
2010/0289735 A1 11/2010 Hosogi et al.
2013/0002141 A1* 1/2013 Lee ..... H05B 33/083 315/152

FOREIGN PATENT DOCUMENTS

JP 2006-108519 A 4/2006
JP 2010-267481 A 11/2010
KR 10-1005199 B1 12/2010
KR 10-2011-0057359 A 6/2011
KR 10-2011-0066664 A 6/2011

* cited by examiner

*Primary Examiner* — Jany Richardson
(74) *Attorney, Agent, or Firm* — Hammer & Associates, P.C.

(57) ABSTRACT

Provided are a light emitting diode (LED) lighting device and a method of controlling the same. The LED lighting includes an LED module in which a plurality of LED arrays having a plurality of LEDs connected in series are connected in parallel, a constant current supply configured to apply a constant current to the LED module, variable resistors connected to the LED arrays in series, respectively, and a controller configured to control the constant current supply and the variable resistors, wherein the controller adjusts the variable resistors and matches overall resistance of the respective LED arrays to maintain balance of a current thereof when one or more current values of measured current values of the LED arrays are in an abnormal range.

11 Claims, 3 Drawing Sheets

LED LIGHTING DEVICE AND METHOD OF CONTROLLING THE SAME

TECHNICAL FIELD

The present invention relates to an LED lighting device and a method of controlling the same.

BACKGROUND ART

Generally, in lighting devices using light emitting diodes (LEDs), a plurality of LEDs are connected in series to form LED arrays, and the plurality of LED arrays are connected in parallel to form LED modules.

When the plurality of LED arrays having the plurality of LEDs connected in series are connected in parallel and are driven, an operating voltage (Vf) of each LED is changed according to an increase in the operation time thereof, and thus, the current of the LED arrays connected in parallel can be unbalanced.

That is, when an LED is in an abnormal state, an amount of current less than a normal current thereof flows in the LED array including the abnormal LED due to an increase in an operating voltage (Vf) of the LED, or an amount of current more than a normal current flows in the LED array including the abnormal LED due to a decrease in the operating voltage (Vf) of the LED. However, since the set current of a constant current generating source is not changed, a current changed in a degraded LED array is increased or decreased and flows into other LED arrays which are not degraded.

Accordingly, the current of the LED arrays is unbalanced, and thus, brightness by the LED array is generally changed and uniform brightness cannot be maintained. Further, when the current of a specific LED array is increased, the lifetime of the LED can be reduced.

Accordingly, to overcome the above problem, an LED driving circuit, in which a constant current circuit is installed in each of the LED arrays to flow a constant current and an unbalanced current flowing in an LED unit is controlled, is disclosed in Korean Laid-Open Patent No. 2009-0011744.

However, although the LED driving circuit blocks voltages applied to LED columns and reduction of the overall lifetime of the LED is protected, when the LED driving circuit is used in the LED lighting device, the LED lighting device is turned off even when one LED device is broken, and thus, it cannot serve as a lighting device at all.

DISCLOSURE

Technical Problem

The present invention is directed to providing a LED lighting device which compensates for an applying current to be constant by reducing the deviation of overall resistance between LED arrays so as to protect an LED when the current between LED arrays is unbalanced.

Technical Solution

One aspect of the present invention provides a light emitting diode (LED) lighting device including: an LED module in which a plurality of LED arrays having a plurality of LEDs connected in series are connected in parallel; a constant current supply configured to apply a constant current to the LED module; variable resistors connected to the respective LED arrays in series, respectively; and a controller configured to control the constant current supply and the variable resistors, wherein the controller calculates combined resistance of the respective LED arrays when one or more current values of measured current values of the LED arrays are in an abnormal range, and adjusts the variable resistors to match overall resistance of the respective LED arrays so as to maintain balance of a current thereof.

In the LED lighting device according to the aspect of the present invention, a normal range may be a range of 90% to 110% of a normal current of each of the LED arrays.

In the LED lighting device according to the aspect of the present invention, when power loss generated by adjusting the variable resistors connected to the respective LED arrays is smaller than a preset reference value, the controller may adjust the variable resistors to match overall resistance thereof.

In the LED lighting device according to the aspect of the present invention, when power loss generated by adjusting the variable resistors connected to the respective LED arrays is greater than a preset reference value, the controller may accumulate current values of LED arrays in the abnormal range among the current values of LED arrays, and control the constant current supply to adjust a current value by as much as the accumulated value of an increased or decreased current.

In the LED lighting device according to the aspect of the present invention, when the power loss generated by adjusting the variable resistors connected to the respective LED arrays is greater than a preset reference value, the controller may adjust the variable resistors until the power loss reaches the preset reference value, accumulate current values of LED arrays in the abnormal range among the current values of LED arrays in a state in which the variable resistors are adjusted, and control the constant current supply to output an adjusted current calculated from a rated current value minus the accumulated current value.

In the LED lighting device according to the aspect of the present invention, the preset reference value may be arbitrarily set to a range of 0.1% to 5% of a rated current value.

The LED lighting device according to the aspect of the present invention may further include a temperature sensor which measures a temperature of a heat dissipation plate disposed on the LED module, and the controller may calculate the combined resistance of the LED array when the temperature of the heat dissipation plate is in a reference temperature range.

In the LED lighting device according to the aspect of the present invention, when one or more current values of the measured current values of the LED arrays are in the abnormal range, the controller may sequentially apply a measuring current to one LED array and measure a voltage ($V_{LED}$) loading to a corresponding LED array so as to sequentially calculate the combined resistance of the respective LED arrays, and the measuring current may be a current which is a rated current divided by the number of the LED arrays.

In the LED lighting device according to the aspect of the present invention, the controller may adjust the variable resistors connected to the remaining LED arrays in series based on an LED array having greatest combined resistance to match overall resistance of the respective LED arrays.

In the LED lighting device according to the aspect of the present invention, the variable resistor may be any one selected from a transistor, a FET, a JFET, an EMOSFET, and a potential meter.

The LED lighting device according to the aspect of the present invention may further include current sensors respectively connected to the LED arrays in series.

In the LED lighting device according to the aspect of the present invention, when one or more current values of the measured current values of the LED arrays are 30% of the normal current or less or 130% of the normal current or more, the controller may block corresponding LED arrays and control the constant current supply to decrease a current value by as much as a total current value of the blocked LED arrays.

Another aspect of the present invention provides a method of controlling an LED lighting device including: determining whether a current value of each of LED arrays is in a normal range or not; measuring combined resistance of the respective LED arrays when one or more current values of the LED arrays are in an abnormal range; calculating compensated resistance to match overall resistance of the respective LED arrays when the combined resistance of the respective LED arrays is different; and controlling variable resistors to have the calculated compensated resistance and matching overall resistance of the respective LED arrays.

ADVANTAGEOUS EFFECTS

According to the present invention, when an LED included in one lighting device is in an abnormal state and balance of a current of one lighting device is not maintained, the balance of the current thereof can be maintained with minimized power loss by matching resistance of respective LED arrays.

Further, since the balance of the current thereof is maintained, it can suppress a failure of an LED array including a specific abnormal LED, and the damage of other LED arrays caused thereby.

MODES OF THE INVENTION

Figure 1:
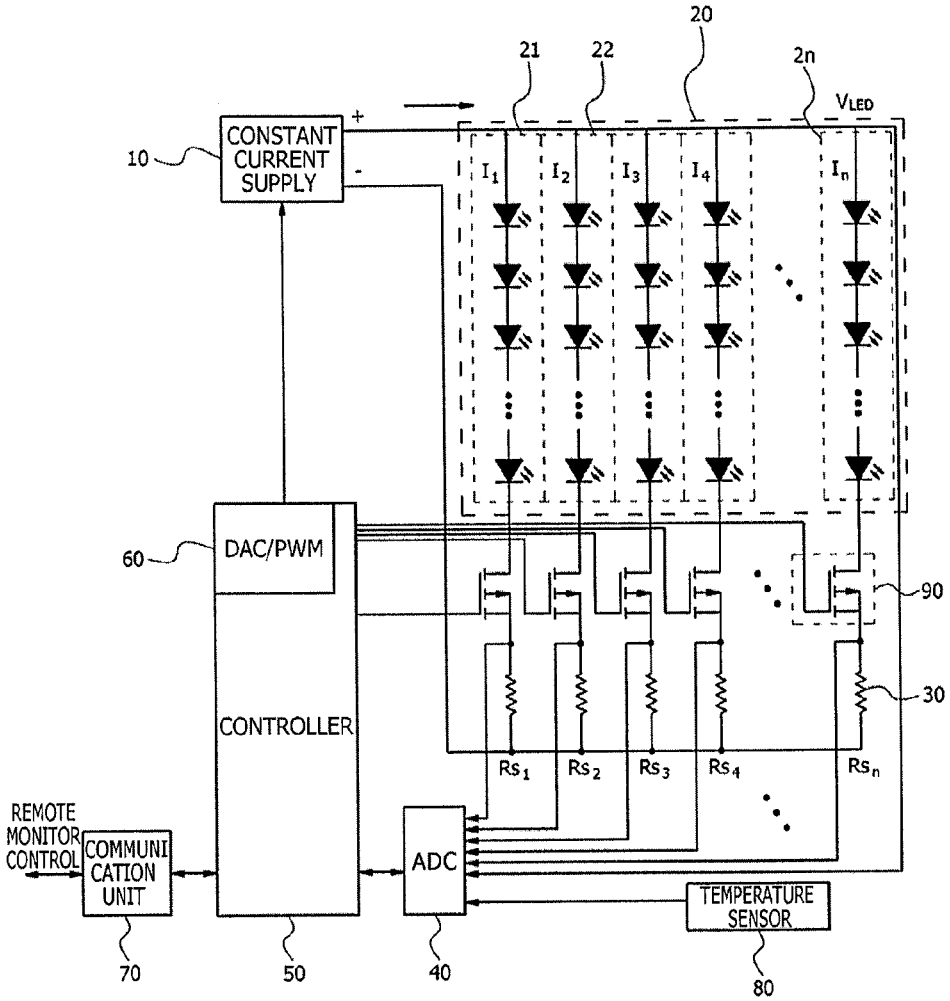
FIG. 1 is a view for describing an LED lighting device according to an embodiment of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention.

The terminology used herein is for the purpose of describing particular embodiments only and is not intended to be limiting of the present inventive concept. As used herein, the singular forms "a," "an," and "the," are intended to include the plural forms as well, unless the context clearly indicates otherwise.

In addition, it will be understood that the size of the drawings may be exaggerated for clarity.

Hereinafter, embodiments of the invention will be described in detail with reference to the accompanying drawings, and regarding elements the same as the above-described elements or corresponding to the above-described elements, the elements may have the same reference numbers as the above-described disclosures unless there is no contradiction, and duplicated descriptions are intended to be omitted.

FIG. 1 is a view for describing a light emitting device (LED) lighting device according to an embodiment of the present invention.

Referring to FIG. 1, the LED lighting device according to the embodiment of the present invention includes an LED module 20 in which a plurality of LED arrays 21 to **2*n* having a plurality of LEDs connected in series are connected in parallel, a constant current supply 10 applying a constant current to the LED module 20, variable resistors 90 connected to the LED arrays 21 to 2N in series, respectively, and a controller 50 which controls the constant current supply 10 and the variable resistors 90**.

The LED module 20 is formed by connecting the plurality of LED arrays 21 to 2N in parallel, and each of the LED arrays 21 to 2N is formed by connecting the plurality of LEDs in series. The LED module 20 may be modified to have various sizes in consideration of an installation place, a structure, etc.

The constant current supply 10 has a well-known configuration in which a constant current is applied to each of the LED arrays 21 to 2N. Here, a direct current (DC) input method includes a series pass method and a switching constant current method, an alternating current (AC) input method includes a converter method, and an output method outputs a DC constant current and serves to adjust an amount of a constant current output by an external control signal in a range of 0 to 5 V.

Further, the constant current supply 10 may use a device controlled by a pulse width modulation (PWM) method, or the constant current supply 10 may use a device controlled by a serial communication method such as RS485, etc. The constant current supply 10 according to the embodiment of the present invention is formed with a single constant current supply.

The variable resistor 90 is a type of current/voltage adjusting device and formed to be connected to each of the LED arrays 21 to 2N in series so that resistance varies according to a gate voltage signal applied from the controller 50. The variable resistor 90 may be any one selected from a transistor (TR), a FET, a JFET, an EMOSFET, and a potential meter.

An analog-to-digital (A/D) converter 40 converts a current applied to each of the LED arrays 21 to 2N, an output voltage of the constant current supply 10, and temperature data of a heat dissipation plate into digital signals.

Sensing resistors 30 are connected to the LED arrays 21 to 2N in series, respectively. Here, it is preferable to design the sensing resistors 30 to use a minimized resistance value so as not to reduce the efficiency of the LED lighting device. However, a current value of each of the LED arrays 21 to 2N may also be sensed using the variable resistor 90 instead of the sensing resistor 30.

When a power source is applied, a controller 50 may read set data of the constant current supply 10 (normal states and ranges including maximum and minimum values of an output voltage, an output constant current, etc.), the number of LED arrays 21 to 2N and the number of LEDs per string, and a set value, a critical value of a current, a critical value of a voltage, a critical value of a temperature, etc. related to the control of variable resistance of each LED array according to LED protection conditions.

Further, the controller 50 receives currents I1 to In from the LED array, an output voltage ($V_{LED}$) of the constant current supply 10, and temperature data of the heat dissipation plate, through the A/D converter 40.

The controller 50 determines whether a measured current value of each of the LED arrays 21 to 2N is in a normal range or not. Here, the normal range of the LED array is set to a range of 90% to 110% of a normal current thereof, but is not limited thereto.

Since a specific LED device is degraded and an operating voltage (Vf) thereof is increased or decreased, one or more current values of the LED arrays 21 to 2N are in an abnormal range.

As described above, when the current is unbalanced, a current of a specific LED array among the LED arrays 21 to 2N is increased or decreased, and thus, brightness by LED array is generally changed and uniform illuminance cannot be maintained. Further, when the current of the specific LED array is increased, the lifetime of the LED is reduced.

Accordingly, the controller 50 calculates combined resistance (equivalent resistance) of the LEDs included in each of the LED arrays 21 to 2N when the unbalanced current is determined.

When the combined resistance of the respective LED arrays 21 to 2N is identical, since LED arrays have different abnormality rather than the LEDs, the balance of the current thereof will be measured again after a predetermined period elapses.

However, when the combined resistance of the respective LED arrays 21 to 2N is different, the occurrence of the abnormal LEDs is detected. Thus, the variable resistors 90 are adjusted to match overall resistance of the respective LED arrays 21 to 2N (combined resistance of the LED arrays+ compensated resistance of the variable resistors +resistance of the sensing resistors) so as to maintain the balance of the current thereof.

Accordingly, the current flowing in each of the LED arrays 21 to 2N is restored to be constant, and thus, uniformity of light may be maintained maximally, and a failure of an overall LED module caused by the abnormality of some LEDs included in the LED module 20 can be protected against.

Further, since the controller 50 uses the variable resistors 90 rather than control of the constant current supply 10, the balance of the current thereof can be maintained with minimized power loss.

Here, it is preferable to calculate combined resistance of each of the LED arrays 21 to 2N when the temperature of the heat dissipation plate, which is received from temperature sensors 80, is in a reference temperature range.

However, even when the resistance values are adjusted using the variable resistors 90, power loss may be generated. When the power loss is greater than a preset reference value, the controller 50 accumulates current values of LED arrays in an abnormal range among current values of the respective LED arrays 21 to 2N, and controls the constant current supply 10 to adjust the current value thereof by as much as a current value accumulated by an increased or decreased current.

Furthermore, in another method, after the controller 50 adjusts the variable resistors 90 until power loss reaches a preset reference value, the controller 50 accumulates current values of LED arrays in an abnormal range among current values of the respective LED arrays 21 to 2N in a state in which the variable resistors 90 are adjusted, and controls the constant current supply 10 to output an adjusted current calculated from a rated current value minus the accumulated current value.

For example, when the reference value is 1% of the rated current value, the variable resistors 90 are adjusted up to a value corresponding to a value having 1% of the rated current value. Then, the controller 50 accumulates current values of LED arrays in an abnormal range in a state in which overall resistance is compensated by the variable resistors 90, and controls the constant current supply 10 to output an adjusted current calculated from the rated current value minus the accumulated current value.

Here, although the reference value is exemplified as 1% of the rated current value, it can be arbitrarily set to a range of 0.1% to 5% of the rated current value.

A pulse width modulator 60 adjusts and outputs a duty rate of a pulse according to a signal received from the controller 50, and thus, controls an amount of a constant current of the constant current supply 10. However, as described above, the constant current supply 10 may use various interfaces other than the pulse width modulator 60.

A communication unit 70 is formed to allow a remote control for states, such as current states I1 to In of each of the LED arrays 21 to 2N, a total output current (IT) of the constant current supply 10, an output voltage ($V_{LED}$), a temperature of the heat dissipation plate, etc., through a serial communication port, and provides a communication interface to allow control of the current of the LED arrays 21 to 2N and change of environmental set values. A compensating resistance calculation control, a variable resistance control, and the like, which will be described below, are allowed in a remote area through the above communication interface, and thus, the balance of the current between LED arrays can be adjusted.

Figure 2:
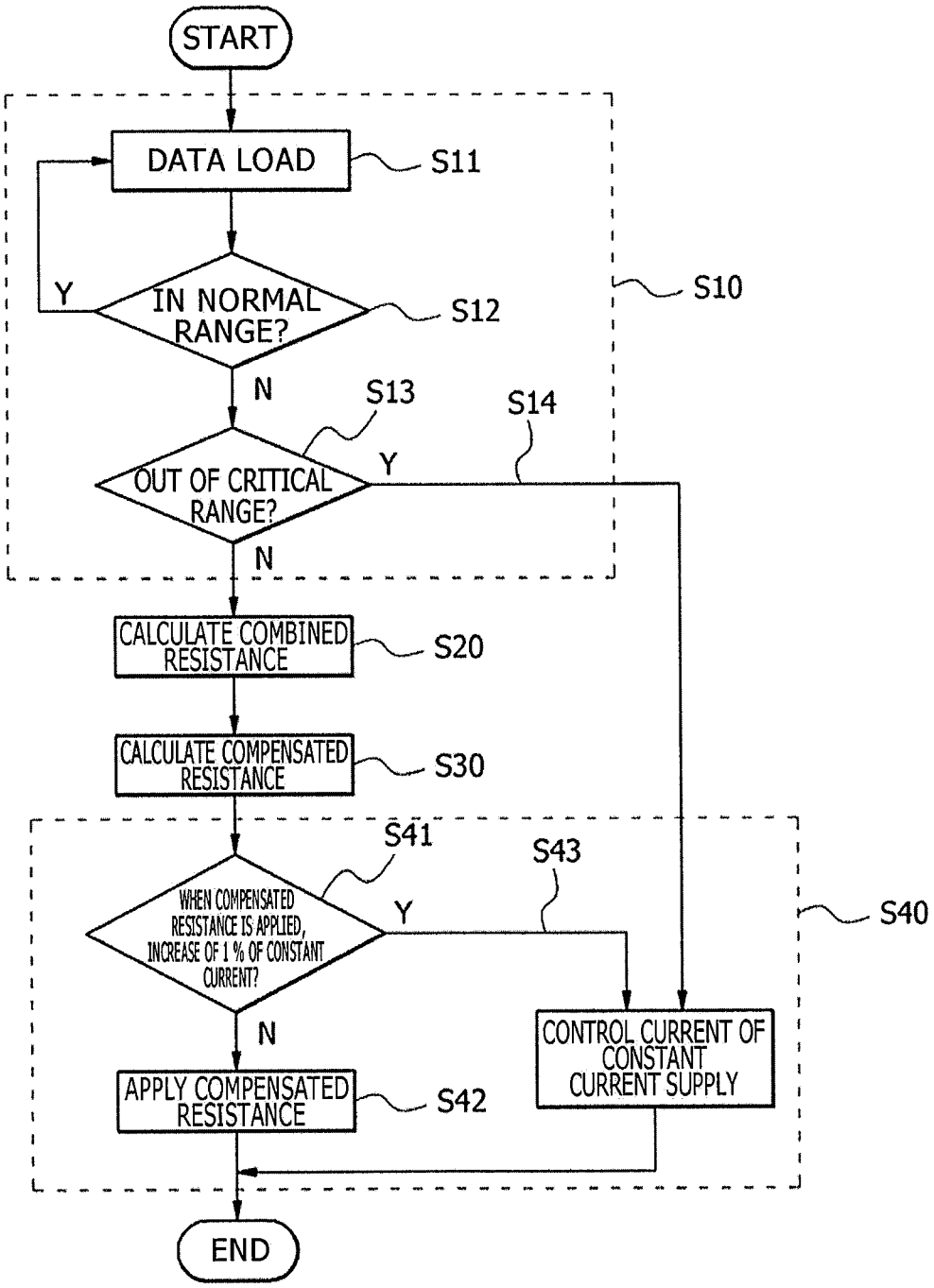
FIG. 2 is a flowchart illustrating a process of maintaining balance of a current measured from each LED array according to an embodiment of the present invention.
Figure 3:
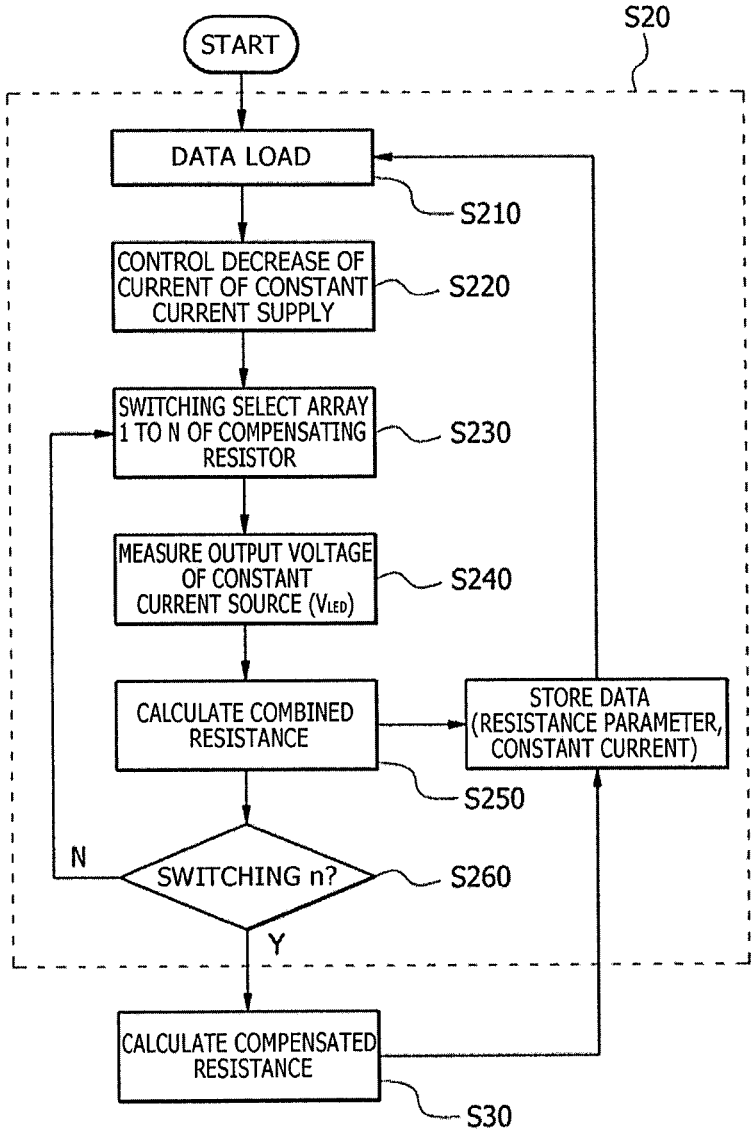
FIG. 3 is a flowchart illustrating a process of calculating compensated resistance to match overall resistance of respective LED arrays.

FIG. 2 is a flowchart illustrating a process of maintaining balance of a current measured from each LED array according to an embodiment of the present invention. FIG. 3 is a flowchart illustrating a process of calculating compensated resistance to match overall resistance of respective LED arrays.

A control method according to the embodiment of the present invention includes determining whether a current value of each of the LED arrays 21 to 2N is in a normal range or not (S10), measuring combined resistance of the respective LED arrays 21 to 2N when one or more current values of the LED arrays 21 to 2N are in an abnormal range (S20), calculating compensated resistance to match overall resistance of the respective LED arrays 21 to 2N when the combined resistance of the respective LED arrays 21 to 2N is different (S30), and matching overall resistance of the respective LED arrays 21 to 2N by controlling the variable resistors 90 so as to have the calculated compensated resistance (S40).

First, the determining whether a current value of each of the LED arrays 21 to 2N is in a normal range or not (S10) will be described. The controller 50 receives data including a current value of each of the LED arrays 21 to 2N (S11) and determines that the occurrence of abnormal LEDs is detected when one or more current values of the LED arrays 21 to 2N are in an abnormal range (S12). Here, a normal range may be set to a range of 90% to 110% of a normal current thereof.

Here, the controller 50 determines whether current values of the LED arrays 21 to 2N are in a critical range or not (S13). The critical range may be set to a range of 30% to 130% of the normal current.

That is, when a current value of each of the LED arrays 21 to 2N is less than 30% of the normal current or more than 130% of the normal current, it is determined that corresponding LED arrays are in an open or short state. Then, the corresponding LED arrays are blocked and the constant current supply 10 is controlled to decrease a current value thereof by as much as a total current value of the corresponding LED arrays (S14).

However, when a current value of each of the LED arrays 21 to 2N is in the abnormal range but still in the critical range, since the LEDs thereof are in an abnormal state but still not in an open or short state, the balance of the current thereof should be maximally maintained by adjusting the constant current supply 10 so as not to be more than a deterioration state.

Then, the measuring of the combined resistance of the respective LED arrays 21 to 2N (S20) and the calculating of the compensated resistance (S30) will be described with reference to FIG. 3.

First, the measuring of the combined resistance of the respective LED arrays 21 to 2N (S20) includes reading data of the LED arrays 21 to 2N, such as a structure, a resistance parameter, a constant current, etc., by the controller 50 (S210).

Then, the constant current is decreased by the controller 50 to maintain a measuring current (S220). The measuring current is a current calculated from a rated current divided by the number of N LED arrays 21 to 2N. For example, when the number of the LED arrays 21 to 2N is five, a measuring current corresponding to ⅕ of the rated current is applied. That is, a normal current of a corresponding LED array is applied.

Then, the variable resistors 90 are selectively switched on (S230) and one of the LED arrays 21 to 2N is selected to be measured. For example, when a first LED array 21 is selected, only the variable resistor 90 of the first LED array 21 is switched on and the variable resistors 90 of the remaining N−1 LED arrays 22 to 2N are blocked by switching off.

Then, the controller 50 measures output voltages ($V_{LED}$) of the plurality of the LEDs included in the first LED array 21 according to operating voltages (Vf) thereof (S240), and calculates combined resistance (equivalent resistance) of the first LED array 21 according to the following Expression 1 (S250).

Expression 1

$$RAn=V_{LED}n/I \text{ (measuring current)}$$

The combined resistance of each of the N−1 LED arrays 22 to 2N is sequentially calculated by the above method.

The calculating of the compensated resistance (S30) includes determining a resistance deviation in the respective LED arrays based on an LED array having the greatest combined resistance (i.e., an array having a smallest current value) when the measured combined resistance has a deviation in the respective LED arrays 21 to 2N. Subsequently, the compensated resistance as much as the resistance deviation is calculated for the respective LED arrays.

Here, since data, such as the combined resistance and compensated resistance, the constant current, etc., is stored in a memory, there is an advantage in that the resistance deviation of the corresponding LED array is known.

Referring again to FIG. 2, in the matching of the overall resistance (S40), the controller 50 determines whether overall power loss generated when the compensated resistance is applied is 1% of the rated current or more or not (S41).

When the overall power loss is less than 1% of the rated current, the variable resistors 90 are controlled to apply the compensated resistance, and thus, the overall resistance of the respective LED arrays 21 to 2N is matched (S42).

As a result, when the overall resistance of the respective LED arrays (combined resistance of the LED array+compensated resistance of the variable resistors+resistance of the sensing resistors) is all matched, the balance of the current is maintained again.

However, when overall power loss generated by adjusting the variable resistors 90 connected to the respective LED arrays 21 to 2N is 1% of the rated current or more, current values in an abnormal range among the current values of the respective LED arrays 21 to 2N are accumulated, and the constant current supply 10 may be controlled to adjust the current value by as much as the accumulated value of the increased or decreased current (S43).

Alternately, the variable resistors 90 are adjusted until the power loss reaches the preset reference value. Then, the controller 50 accumulates current values of LED arrays in an abnormal range in a state in which overall resistance is compensated by the variable resistors 90, and controls the constant current supply 10 to output an adjusted current calculated from the rated current value minus the accumulated current value.

Here, although the reference value is exemplified as 1% of the rated current value, it can be arbitrarily set to a range of 0.1% to 5% of the rated current value. Although a few embodiments have been described, those skilled in the art will readily appreciate that many modifications are possible in embodiments without materially departing from the novel teachings and advantages. Accordingly, all such modifications are intended to be included within the scope of this inventive concept as defined in the claims.

The invention claimed is:

1. An LED lighting device, comprising:

an LED module in which a plurality of light emitting diode (LED) arrays having a plurality of LEDs connected in series are connected in parallel;

a constant current supply configured to apply a constant current to the LED module;

variable resistors connected to the LED arrays in series, respectively; and a controller configured to control the constant current supply and the variable resistors, wherein the controller adjusts the variable resistors and matches overall resistance of the respective LED arrays to maintain balance of a current thereof when one or more current values of measured current values of the LED arrays are in an abnormal range, wherein the controller calculates combined resistance of the respective LED arrays when one or more current values of the measured current values of the LED arrays are in the abnormal range, and adjusts the variable resistors when combined resistance of the respective LED arrays is different, wherein a normal range is a range of 90% to 110% of a normal current of each of the LED arrays, wherein when power loss generated by adjusting the variable resistors connected to the respective LED arrays is greater than a preset reference value, the controller adjusts the variable resistors until the power loss reaches the preset reference value, accumulates current values of LED arrays in the abnormal range among the current values of LED arrays in a state in which the variable resistors are adjusted, and controls the constant current supply to output an adjusted current calculated from a rated current value minus the accumulated current value.

2. The LED lighting device of claim 1, wherein when power loss generated by adjusting the variable resistors connected to the respective LED arrays is smaller than a preset reference value, the controller adjusts the variable resistors to match overall resistance thereof.

3. The LED lighting device of claim 2, wherein the preset reference value is arbitrarily set to a range of 0.1% to 5% of a rated current value.

4. The LED lighting device of claim 1, wherein when one or more current values of the measured current values of the LED arrays are in the abnormal range, the controller sequentially applies a measuring current to one LED array and measures a voltage ($V_{LED}$) loading to a corresponding LED array so as to sequentially calculate the combined resistance of the respective LED arrays.

5. The LED lighting device of claim 4, wherein the controller adjusts the variable resistors connected to the remaining LED arrays in series based on an LED array having greatest combined resistance to match overall resistance of the respective LED arrays.

6. The LED lighting device of claim 1, wherein the LED lighting device controls a set value of a lighting device in a remote area through an interface in communication with the controller, and monitors a state of the lighting device.

7. The LED lighting device of claim 1, further comprising current sensors respectively connected to the LED arrays in series.

8. The LED lighting device of claim 1, wherein when one or more current values of the measured current values of the LED arrays are 30% of the normal current or less or 130% of the normal current or more, the controller blocks corresponding LED arrays and controls the constant current supply to decrease a current value by as much as a total current value of the blocked LED arrays.

9. A method of controlling an LED lighting device, comprising:

determining whether a current value of each of LED arrays is in a normal range or not;

measuring combined resistance of the respective LED arrays when one or more current values of the LED arrays are in an abnormal range;

calculating compensated resistance to match overall resistance of the respective LED arrays when the combined resistance of the respective LED arrays is different; and controlling variable resistors to have the calculated compensated resistance and matching overall resistance of the respective LED arrays, wherein when power loss generated by adjusting the variable resistors connected to the respective LED arrays is greater than a preset reference value, the controller adjusts the variable resistors until the power loss reaches the preset reference value, accumulates current values of LED arrays in the abnormal range among the current values of LED arrays in a state in which the variable resistors are adjusted, and controls the constant current supply to output an adjusted current calculated from a rated current value minus the accumulated current value.

10. The method of claim 9, wherein the calculating of the compensated resistance includes sequentially applying a measuring current to one LED array to measure a voltage ($V_{LED}$) loading to a corresponding LED array so as to sequentially calculate the combined resistance of the respective LED array.

11. The method of claim 9, wherein the matching of the overall resistance includes adjusting the variable resistors to match overall resistance thereof when power loss generated by adjusting the variable resistors connected to the respective LED arrays is smaller than a preset reference value.

* * * * *